US006556132B1

(12) United States Patent
Pattok et al.

(10) Patent No.: US 6,556,132 B1
(45) Date of Patent: Apr. 29, 2003

(54) STROBE CIRCUIT

(75) Inventors: Greg R. Pattok, Holland, MI (US); John R. Pacelli, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 0 days.

(21) Appl. No.: 09/939,254

(22) Filed: Aug. 24, 2001

(51) Int. Cl.[7] ..... G08B 5/00; H05B 39/00; H05B 41/00

(52) U.S. Cl. ..... 340/331; 340/332; 340/815.4; 315/241 S

(58) Field of Search ..... 340/331, 332, 340/815.4, 815.52, 815.73, 815.75, 512, 641, 691.1, 691.2; 315/129, 135, 200 A, 241 S

(56) References Cited

U.S. PATENT DOCUMENTS

| | | | | | |
|---|---|---|---|---|---|
| 4,300,133 | A | | 11/1981 | Solomon | 340/630 |
| 4,701,672 | A | * | 10/1987 | Sikora | 315/241 S |
| 4,860,148 | A | | 8/1989 | Iwamura et al. | 361/58 |
| 4,916,432 | A | | 4/1990 | Tice et al. | 340/518 |
| 4,949,017 | A | * | 8/1990 | Sikora | 315/219 |
| 4,952,906 | A | * | 8/1990 | Buyak et al. | 340/331 |
| 5,105,126 | A | * | 4/1992 | Whitesel | 315/241 R |
| 5,179,488 | A | | 1/1993 | Rovner | 361/18 |
| 5,187,653 | A | | 2/1993 | Lorenz | 363/89 |
| 5,189,344 | A | * | 2/1993 | Rose | 315/293 |
| 5,400,009 | A | * | 3/1995 | Kosich et al. | 340/331 |
| 5,598,139 | A | * | 1/1997 | Karim et al. | 340/286.11 |
| 5,602,522 | A | | 2/1997 | Pacelli | 340/331 |
| 5,659,287 | A | * | 8/1997 | Donati et al. | 340/331 |
| 5,793,589 | A | | 8/1998 | Friedl | 361/58 |
| 5,850,178 | A | * | 12/1998 | Ha et al. | 340/512 |
| 5,886,431 | A | | 3/1999 | Rutigliano | 307/131 |
| 5,886,620 | A | * | 3/1999 | Stewart et al. | 340/332 |
| 5,896,092 | A | | 4/1999 | Bechtel | 340/815.73 |
| 5,962,984 | A | * | 10/1999 | Mashburn, III et al. | 315/200 A |
| 6,049,446 | A | | 4/2000 | Ha et al. | 361/58 |
| 6,243,001 | B1 | * | 6/2001 | Kodaka | 340/326 |

* cited by examiner

*Primary Examiner*—Toan Pham
(74) *Attorney, Agent, or Firm*—Price, Heneveld, Cooper, DeWitt & Litton

(57) ABSTRACT

A visual alarm device includes a flash tube that provides a visual indication responsive to trigger a signal. A strobe circuit is coupled between the flash tube and a power source and causes a flash tube to emit light at a desired flash rate. The strobe circuit includes a storage circuit, an in-rush current limiting circuit control unit.

22 Claims, 11 Drawing Sheets

STROBE CIRCUIT

BACKGROUND OF THE INVENTION

The present invention is directed to a visual signaling system and, more specifically, a strobe circuit for a visual signaling system.

Signaling systems have been utilized in various areas of commercial and residential buildings, as well as in outside areas, for the purpose of attracting the attention of a person to, for example, warn of a danger of a fire or to alert such persons to a telephone call, damong other purposes. Many of these visual signaling systems include one or more visual signaling devices that have a flash tube that contains a gas, e.g., Xenon, that is ionized at the direction of a control circuit that receives power from a power supply, typically located at a control panel. Visual signaling systems have generally included a number of visual signaling devices coupled in parallel to the power supply, which supplies power to the devices. The visual signaling devices typically include one or more storage capacitors for storing the energy used to flash the strobe. In such visual signaling systems, the current drawn by the visual signaling devices may exceed the capability of a power supply (e.g., a DC power supply), upon initial power-up, due in large part to the discharged state of the one or more filter and storage capacitors.

As such, a number of techniques have been implemented to limit an in-rush current to a particular visual signaling device. For example, one device implements a thermistor between filter and storage capacitors and a power supply. The thermistor functions to initially limit an in-rush current at power-up and, as it continues to heat, transitions to a lower resistance such that the resistance is substantially reduced between the power supply and the storage capacitor of the visual signaling device.

Another signaling device uses a bipolar pass transistor whose emitter and collector are in series between a power supply and a storage capacitor. The device includes a series resistor coupled between the emitter of the pass transistor and the power supply. A base of a bipolar shut-off transistor is coupled to the emitter of the pass transistor. A collector of the shut-off transistor is coupled to a base of the pass transistor and an emitter of the shut-off transistor is coupled to the power supply. When an in-rush current threshold value (set by the value of the series resistor) is exceeded, the shut-off transistor turns on thereby limiting the base current of the pass transistor, which limits the current flowing into the storage capacitor through the pass transistor.

Yet another device uses a field effect transistor (FET) whose source is coupled to a power supply and whose drain is coupled to a storage capacitor. A resistor, coupled across the source and drain of the FET, is utilized to limit in-rush current. A control circuit, coupled to a gate of the FET, turns the FET on to provide a low impedance path between the power supply and the storage circuit after an elapsed time interval. While the prior art signaling devices function, they have not, in general, charged the flash circuit in an efficient manner, maintained a controlled breakover voltage for the flash tube and provided selectable flash intensities.

Thus, it would be desirable to provide a visual alarm device including a strobe circuit that reduces in-rush current while efficiently charging a storage circuit, provides selectable flash intensities and maintains a controlled breakover voltage for a flash tube.

SUMMARY OF THE INVENTION

An embodiment of the present invention is directed to a visual alarm device that includes a flash tube and a strobe circuit. The flash tube provides a visual indication responsive to a trigger signal. The strobe circuit is coupled between the flash tube and a power source and causes the flash tube to emit light at a desired flash rate. In one embodiment, the strobe circuit includes a storage circuit, an in-rush current limiting circuit and a control unit. The in-rush current limiting circuit is coupled between the storage circuit and the power source and includes a first switching device with a control input. The control unit is coupled to the control input and periodically asserts a control signal on the control input, which causes the first switching device to provide power to the storage circuit. The control signal includes a plurality of fixed duration pulses provided during a first predetermined time period.

These and other features, advantages and objects of the present invention will be further understood and appreciated by those skilled in the art by reference to the following specification, claims, and appended drawings.

DETAILED DESCRIPTION OF PREFERRED EMBODIMENTS

The present invention is directed to a strobe circuit that efficiently charges an associated storage circuit, maintains a controlled breakover voltage for a flash tube, reduces in-rush current to the strobe circuit and provides selectable flash intensities. Preferably, the strobe circuit is coupled to a power supply (e.g., with an output in the range of sixteen to thirty-three volts) that resides at a fire panel. When a controller of the fire panel determines that an alarm condition exists, the control unit of the fire panel causes the power supply to be connected to the strobe circuit, thus providing power to the strobe circuit.

Figure 1:
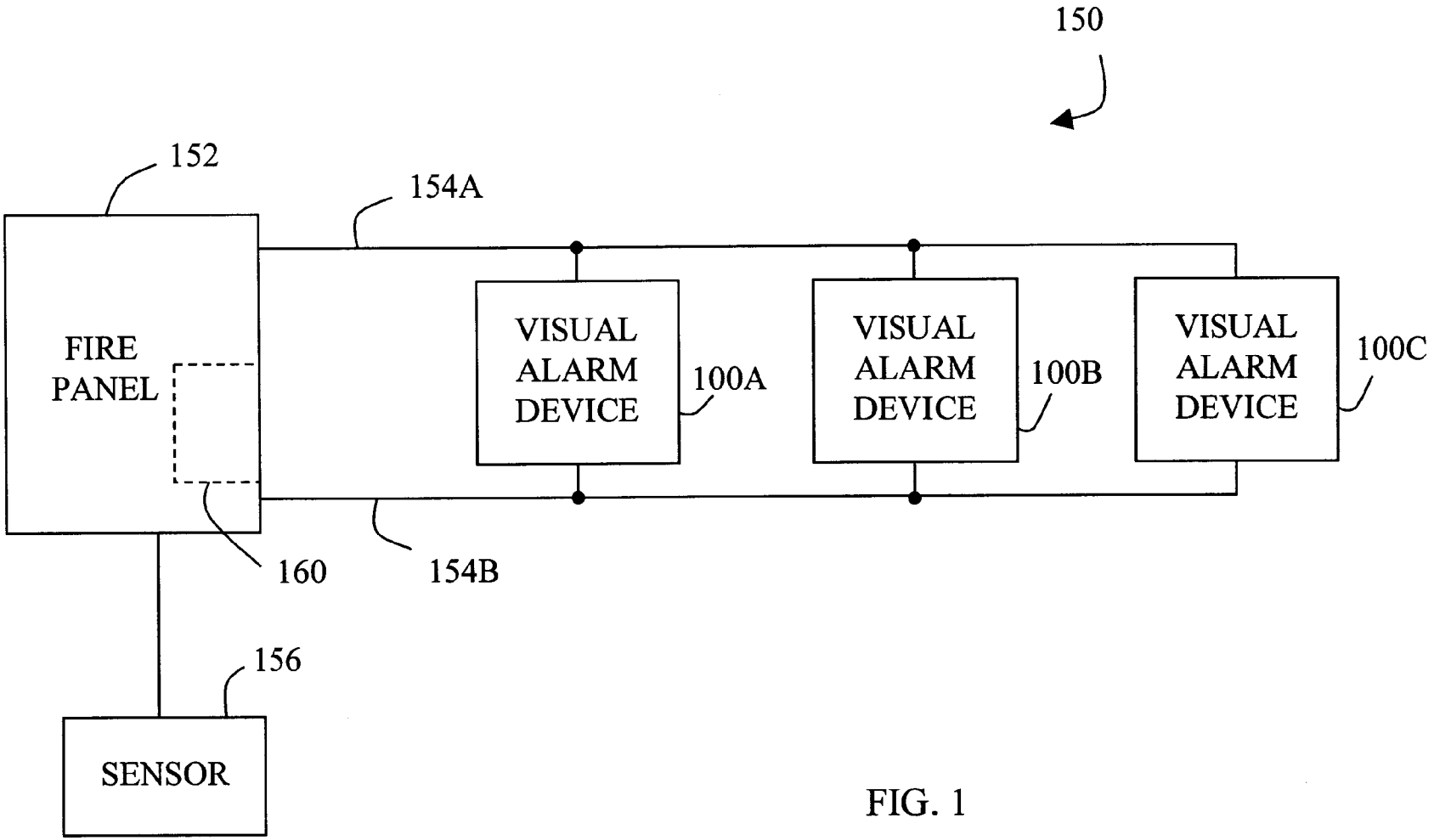
FIG. 1 is an electrical block diagram of an exemplary visual signaling system, according to an embodiment of the present invention.

FIG. 1 depicts a block diagram of an exemplary visual signaling system 150 that includes a fire panel 152 that is coupled to one or more sensors (for example, an obscuration sensor, a scatter sensor and/or an ionization detector) 156 and includes a power supply 160. Examples of preferred sensors are disclosed in commonly assigned U.S. patent application Ser. No. 09/844,229, the entire disclosure of which is incorporated herein by reference. When a controller (not shown in FIG. 1) of the system 150 receives an alarm indication from the sensor 156, the controller activates the power supply 160 providing power to a plurality of visual alarm devices 10A, 100B and 100C, via power supply lines 154A and 154B. In a preferred embodiment, the controller of the panel 152 is capable of providing a synchronization signal with a duration of at least five milliseconds, on the power supply line 154A, to the plurality of visual alarm devices, which are preferably constructed according to the present invention.

Figure 2:
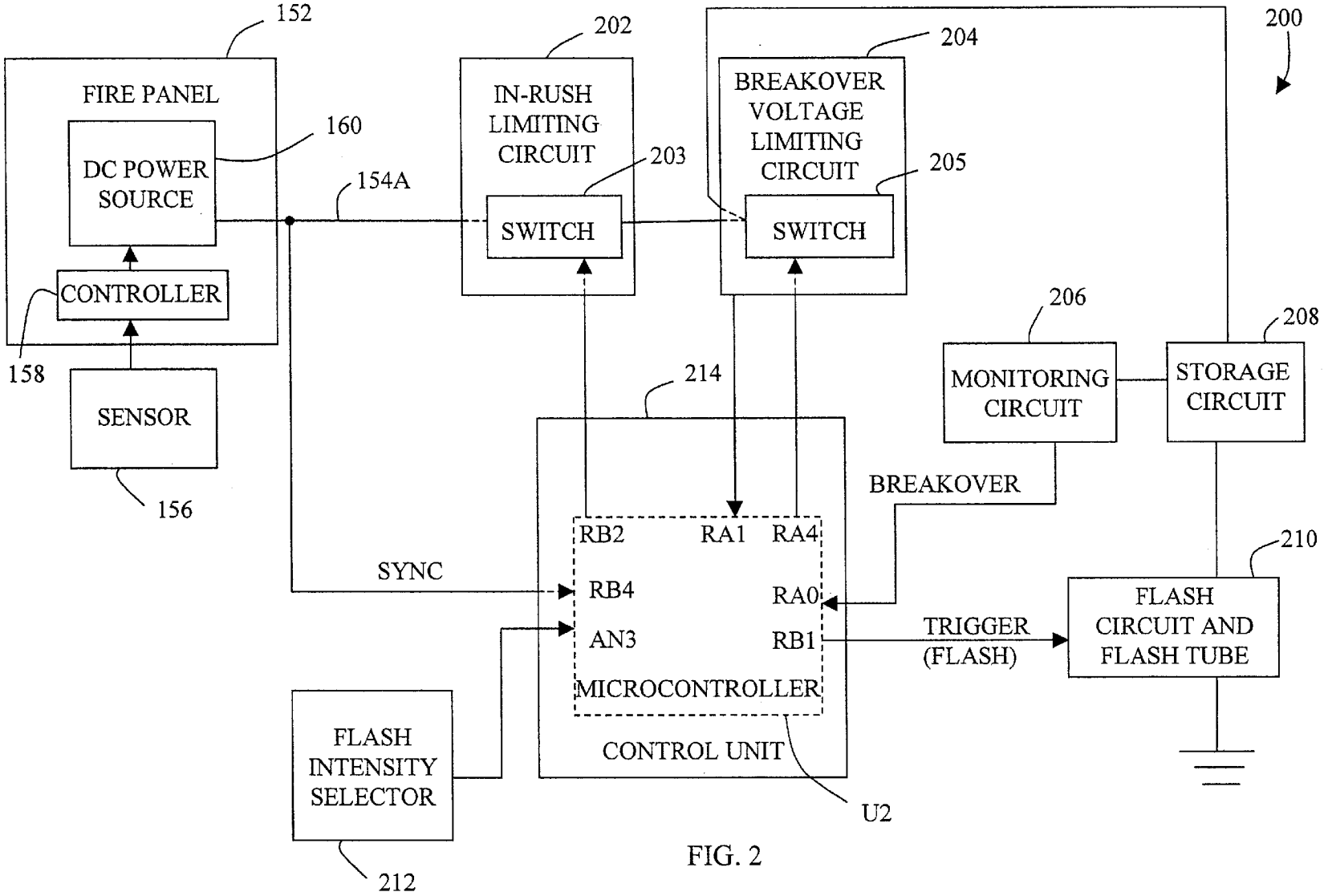
FIG. 2 is an electrical block diagram of an exemplary visual signaling system, according to another embodiment of the present invention.

FIG. 2 depicts an exemplary alarm system 200, according to another embodiment of the present invention. As shown in FIG. 2, a fire panel 152 includes a power source (e.g., a DC power source) 160 that is controlled by a controller 158 responsive to an input signal from a sensor 156. When the sensor 156 indicates an alarm condition, the controller 158 activates the power source 160, which is connected to the strobe circuit via the power lines 154A and 154B (not shown in FIG. 2). The power line 154A is coupled to an in-rush limiting circuit 202, which includes a switch 203, that provides power from the power source 160 to a breakover voltage limiting circuit 204, which includes a switch 205. The power from the power source 160 is provided through the switch 203 to various filter capacitors and a storage circuit 208 responsive to a control unit 214. The storage circuit 208 provides energy to flash a flash tube of flash circuit 210.

According to another embodiment of the present invention, a microcontroller U2 of the control unit 214 provides a trigger signal on an output RB1. The microcontroller U2 receives a breakover signal from a monitoring circuit 206, which is coupled to the storage circuit 208, on an input RA0. The monitoring circuit 206 provides an indication of a voltage level of the storage circuit 208. The microcontroller also monitors the current through the switch 205 at an input RA1. The microcontroller U2, of the control unit 214, controls the switch 205 through output RA4 responsive to the breakover signal provided by the monitoring circuit 206. A flash intensity selector 212 is coupled to an input AN3 of the microcontroller U2 and allows a user of the system to select a desired flash intensity. The microcontroller U2 also monitors a synchronization signal (SYNC) at an input RB4 to determine when power is provided from the power source 160 to the strobe circuit 200. At an appropriate interval, which may correspond to the SYNC signal going to low level, the microcontroller U2 provides an appropriate signal on an output RB1 to trigger the flash tube of the flash circuit 210.

Figure 3A:
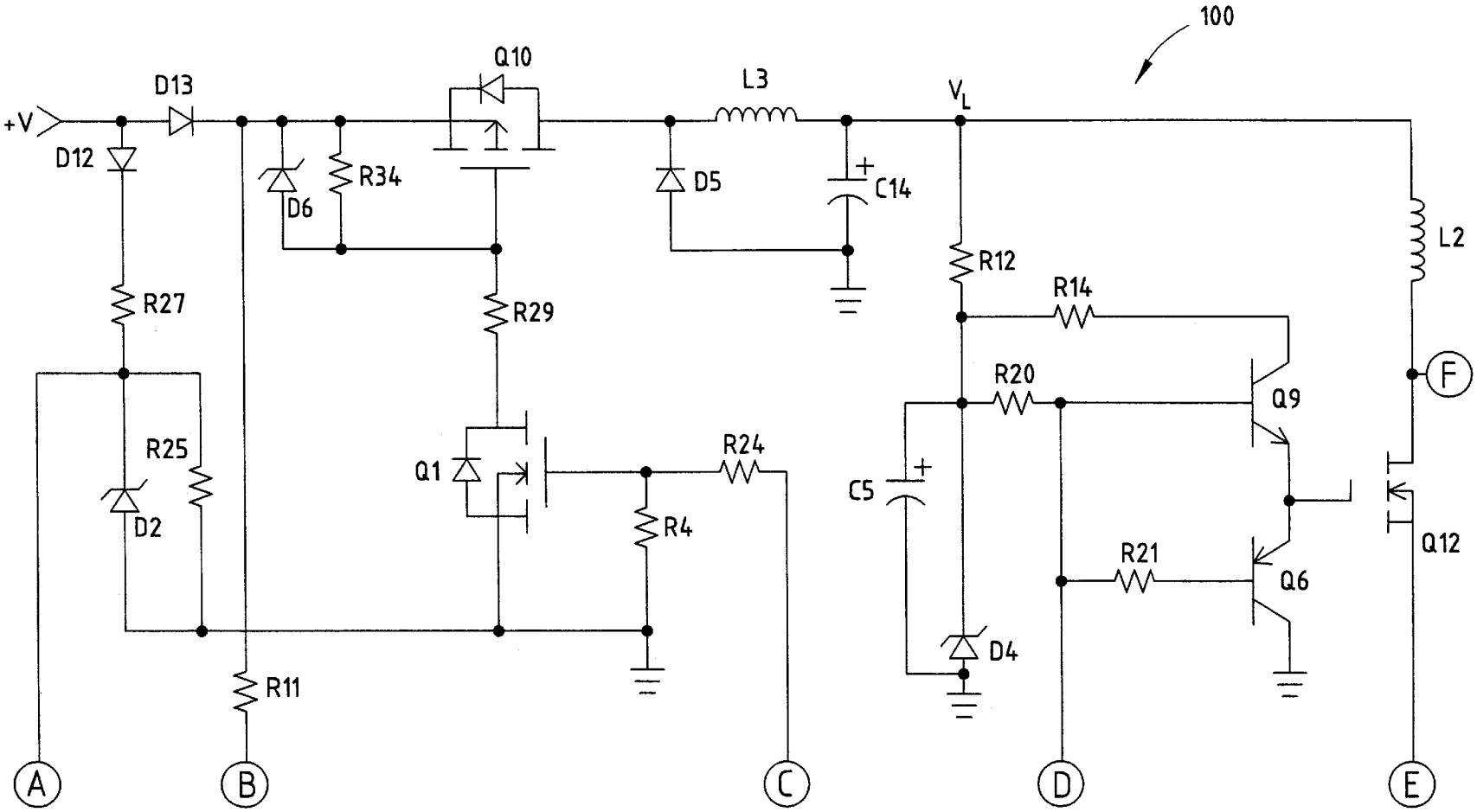
FIGS. 3A–3C are an electrical schematic of a strobe circuit including a flash tube, according to one embodiment of the present invention.
Figure 3B:
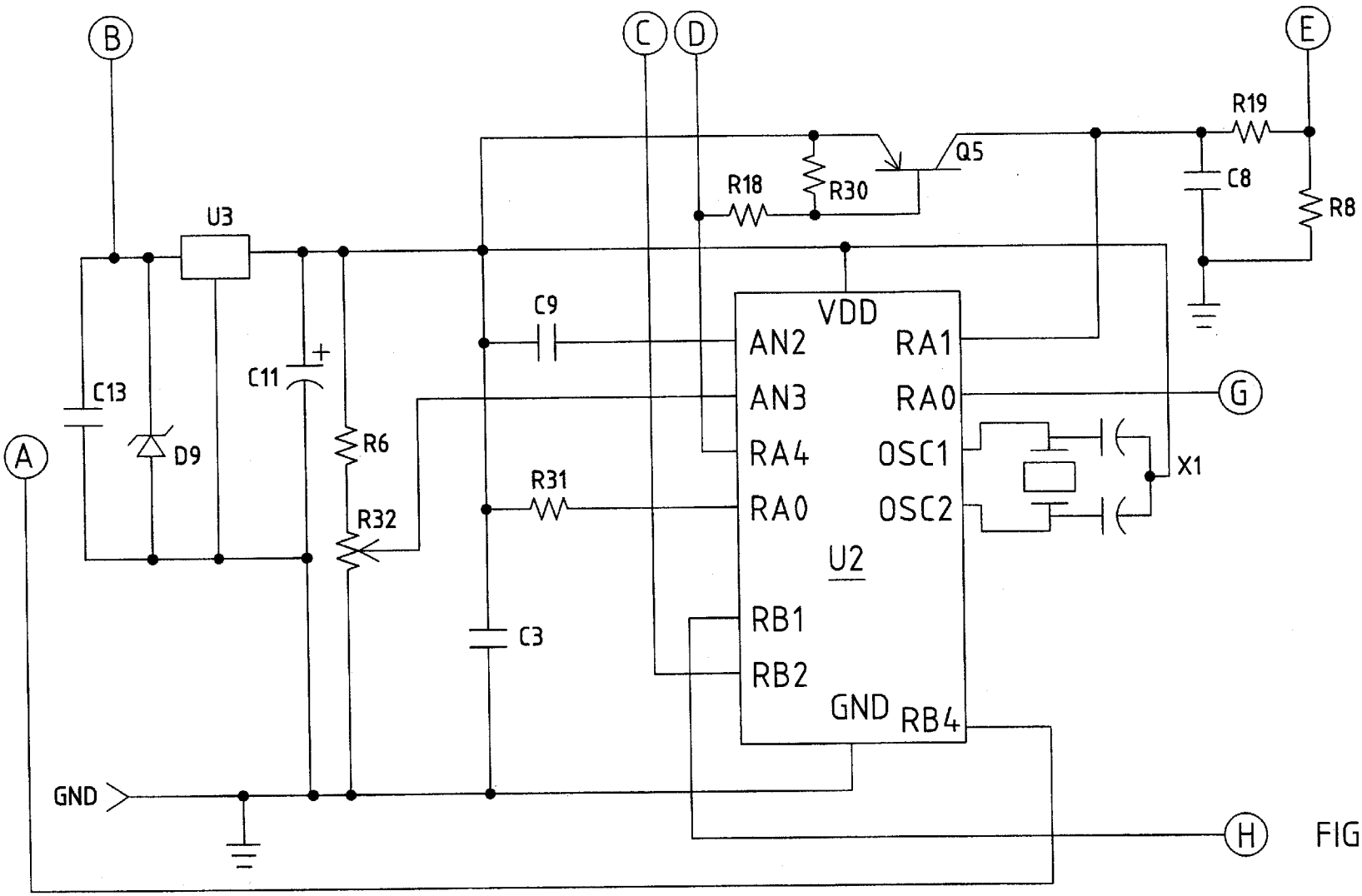
Figure 3C:
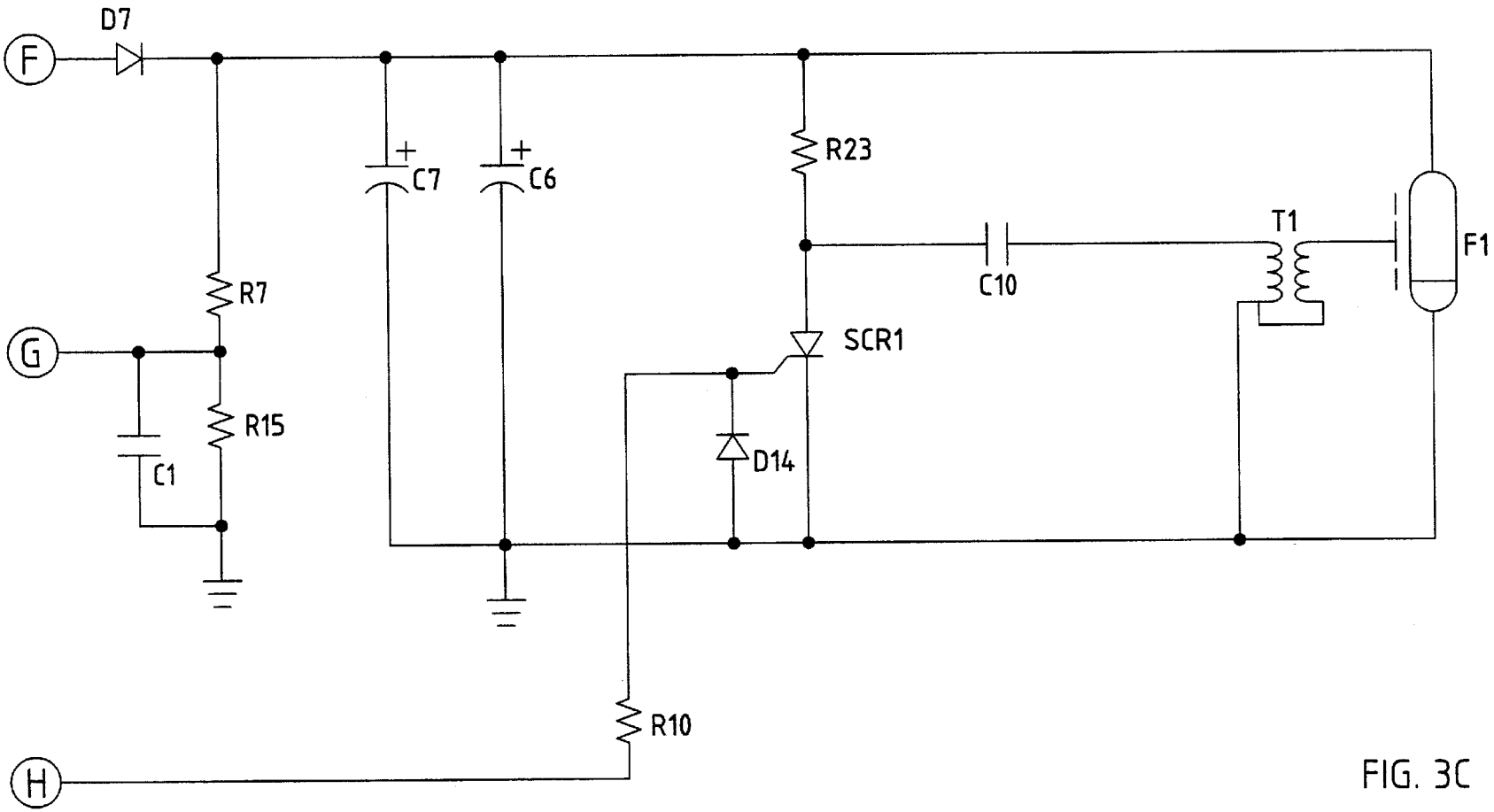

Turning to FIGS. 3A–3C, in normal operation, a positive terminal of a power supply is coupled to a +V terminal of a strobe circuit 100 and a ground of the power supply is coupled to a common ground terminal (GND) of the circuit 100. As is explained further below, the strobe circuit 100 includes a microcontroller U2 that is powered by the power supplied from the power supply. When the power supply is brought on-line by the fire panel controller, current flows through diode D12, resistor R27 (e.g., 10k ohm) and zener diode D2 (e.g., 4.7 volts). The zener diode D2 serves to protect an input RB4 of the microcontroller U2 and the resistor R27 limits the current that flows through the zener diode D2. The diode D12 blocks negative transients such that various components of the strobe circuit 100 are not damaged. The microcontroller U2 monitors the input RB4 to determine whether a synchronization (SYNC) pulse has been received and to determine when power is supplied to the strobe circuit 100.

Operating power for the circuit 100 is also derived from the power supply through diode D13, which also protects the various components of the circuit 100 from negative going transients. A resistor R11 (e.g., 470 ohm) is coupled to a cathode of the diode D13 and provides power to an input of a voltage regulator U3, which provides regulated power to various components of the circuit 100 on an output. A capacitor C13 (e.g., 47 $\mu$F) filters the input to the regulator U3 and a zener diode D9 protects the input of the regulator U3 from excessive voltages.

The output of the regulator U3 is filtered by a capacitor C11 (e.g., 330 $\mu$F). A cathode of the diode D13 is also coupled to a cathode of a zener diode D6 and a first side of a resistor R34 (e.g., 15k ohm). A second side of the resistor R34 and an anode of the zener diode D6 are coupled to a gate of a field effect transistor (FET) Q10. A source of the FET Q10 is also coupled to the cathode of the diode D13 and a drain of the FET Q1O is coupled to a first side of an inductor L3 (e:g., 1 mH) and a cathode of a diode D5. A second side of the inductor L3 is coupled to a first side of a capacitor C14 (e.g., 100 $\mu$F) and a second side of the capacitor C14 is coupled to the common ground along with the anode of diode D5.

Upon receiving power from the power supply and after going through an initialization routine and after each flash, the microcontroller U2 applies a series of pulses on an output RB2, which is coupled to a gate of a FET Q1, via a resistor R24 (e.g., 10 ohm). A resistor R4 (e.g., 10k ohm) is coupled between the gate of FET Q1 and the common ground and in combination with the resistor R24 provides a resistive divider network between the output RB2 and the gate of the FET Q1. A source of the FET Q1 is coupled to the common ground and a drain of the FET Q1 is coupled to the gate of the FET Q1 via a resistor R29 (e.g., 22k ohm), which serves to provide a turn on signal to the gate of the FET Q1 when the FET Q1 conducts.

Figure 4A:
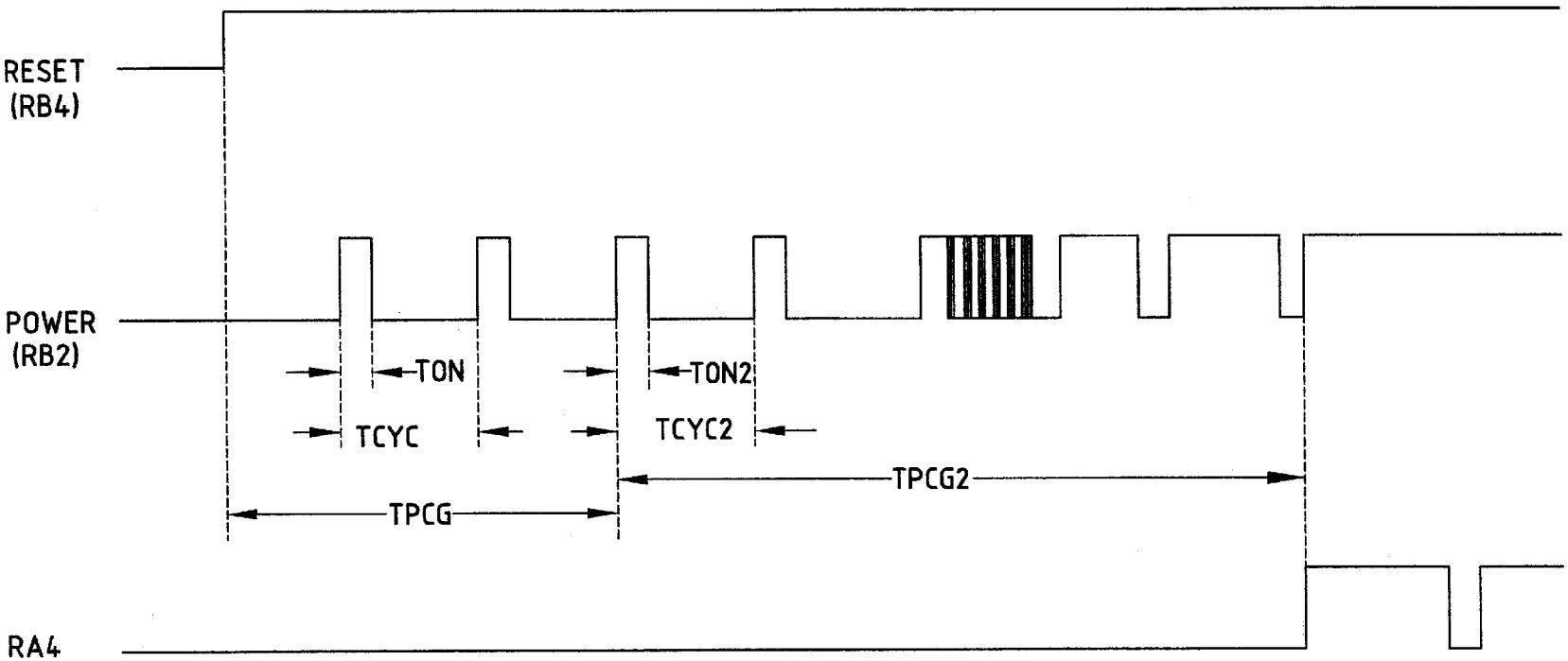
FIGS. 4A–4C are timing diagrams of various signals associated with the strobe circuit of FIGS. 3A–3C.

At initial power-up and during a first predetermined time period TPCG (see FIG. 4A), the microcontroller U2 provides a series of pulses on the output RB2 that have a period of TCYC, e.g., ninety-eight microseconds, and an on-time TON, e.g., three microseconds. During the period TPCG, e.g., five-hundred milliseconds, the microprocessor U2 preferably provides a three microsecond pulse every ninety-five microseconds. During a second predetermined time period TPCG2, e.g., five-hundred milliseconds, the microcontroller U2 provides a pulse with an initial pulse width of an on-time variable TON2, e.g., four microseconds, each cycle time period TCYC2, e.g., one-hundred microseconds, and increments the on-time variable TON2 1.5 microseconds each 8.1 milliseconds. In this manner, at the end of the period TPCG2 the duty cycle of the on-time variable TON2 pulse is one-hundred percent. At the beginning of each flash charge cycle, the microcontroller U2 provides a series of pulses with an on-time TPH (e.g., sixty-six microseconds) and an off-time TPL (e.g., fifty-five microseconds) for a period TPP, e.g., four milliseconds, to replenish charge lost from the storage circuit in order to reduce in-rush current at the beginning of a new storage circuit charge cycle.

Figure 4C:
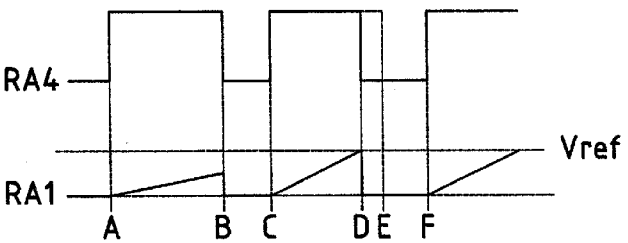
Figure 4B:
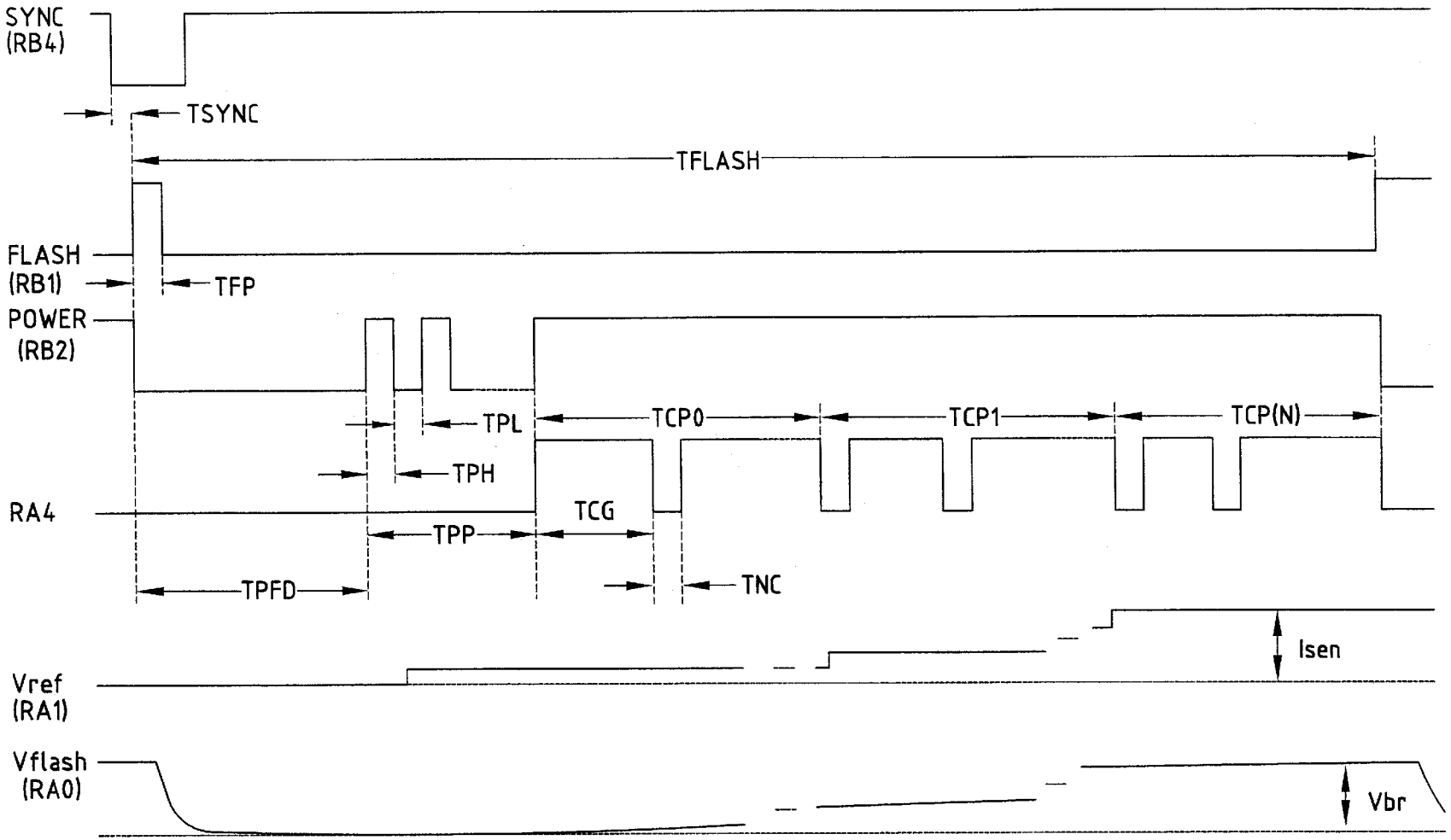
Figure 5A:
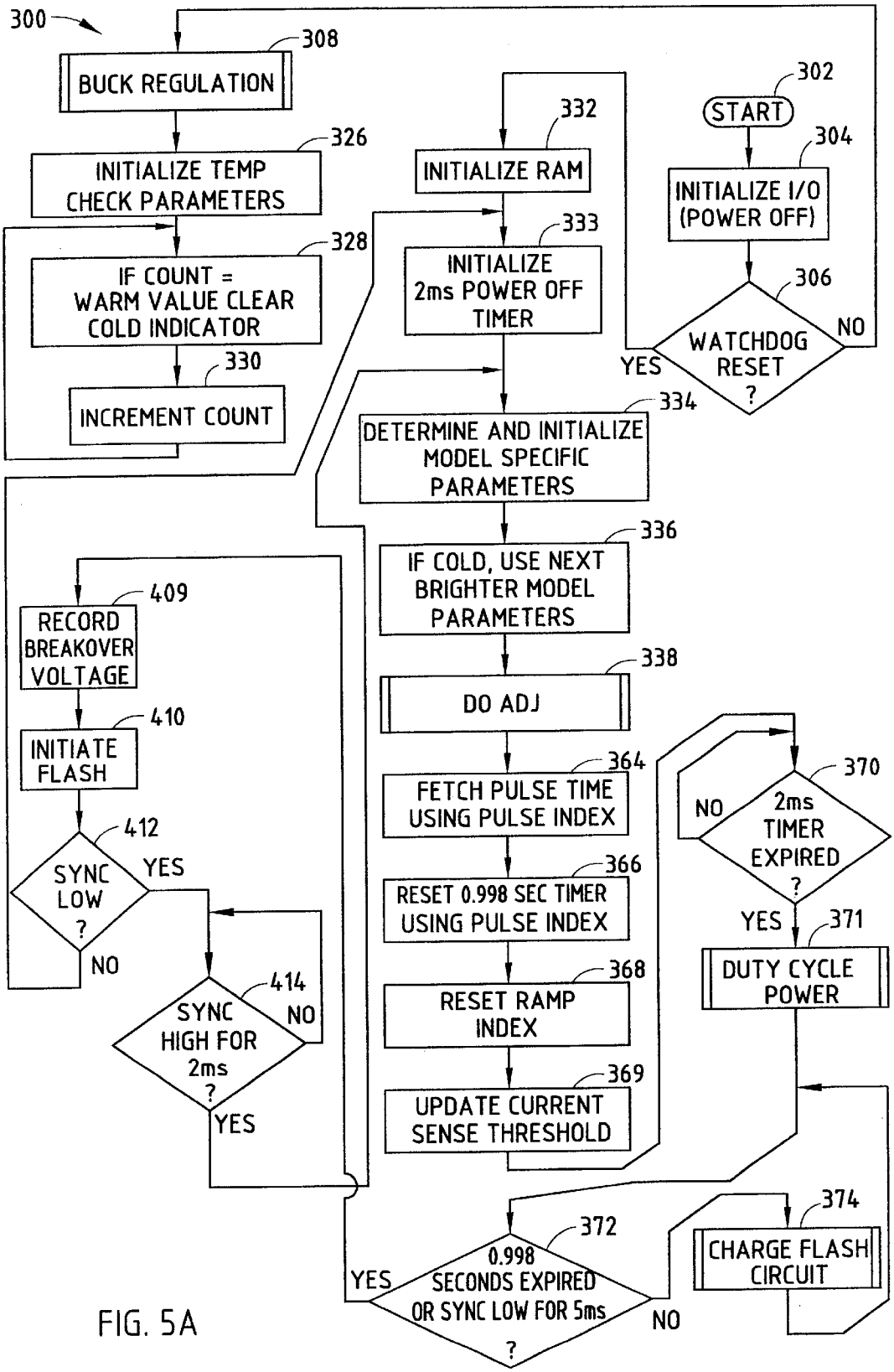
FIGS. 5A–5E are a flowchart of an exemplary routine that executes on the control unit of the strobe circuit of FIGS. 3A–3C.
Figure 5B:
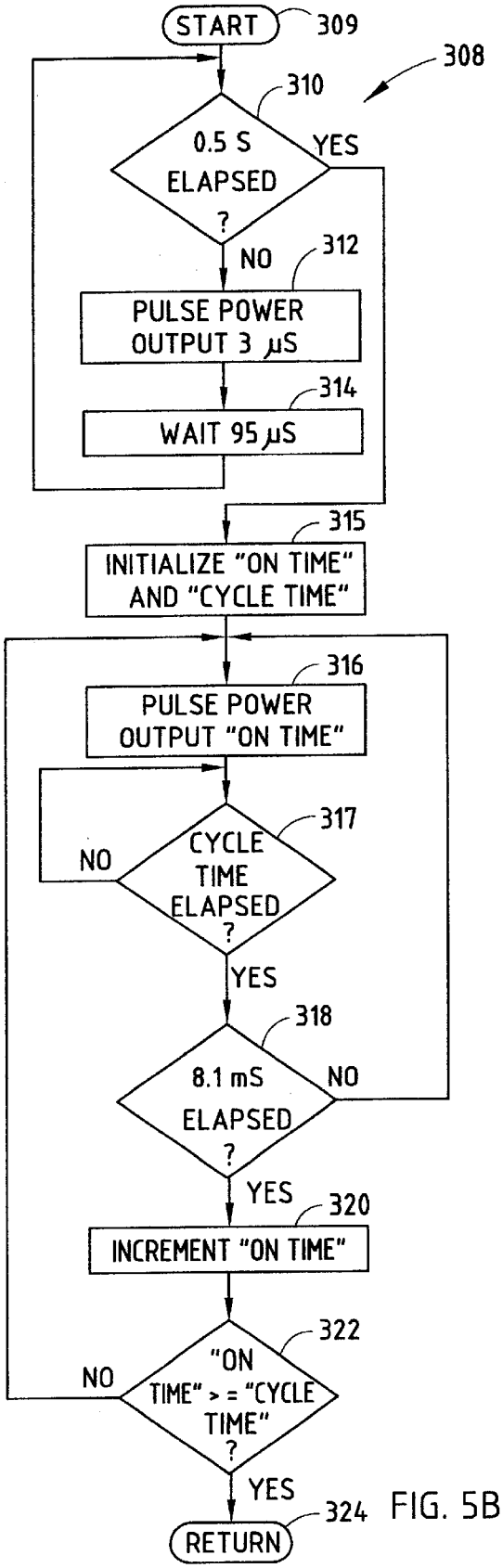
Figure 5D:
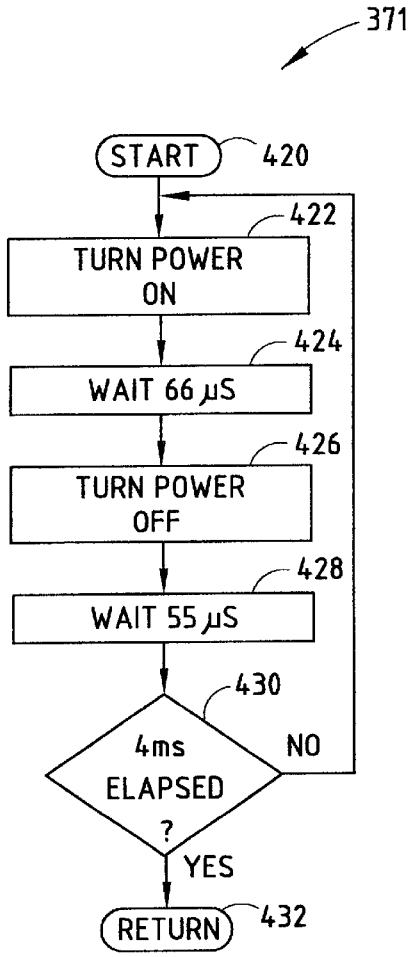
Figure 5C:
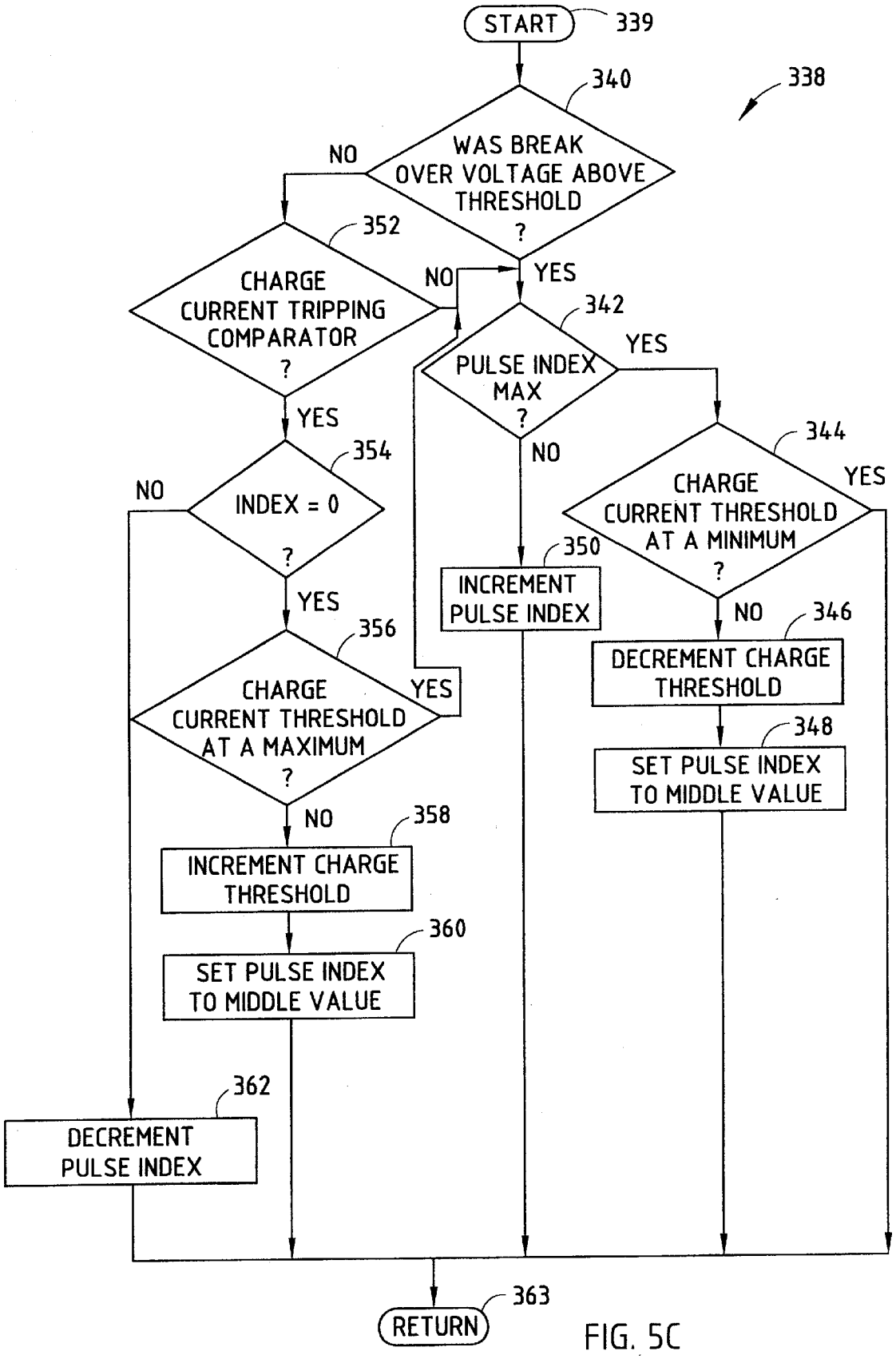
Figure 5E:
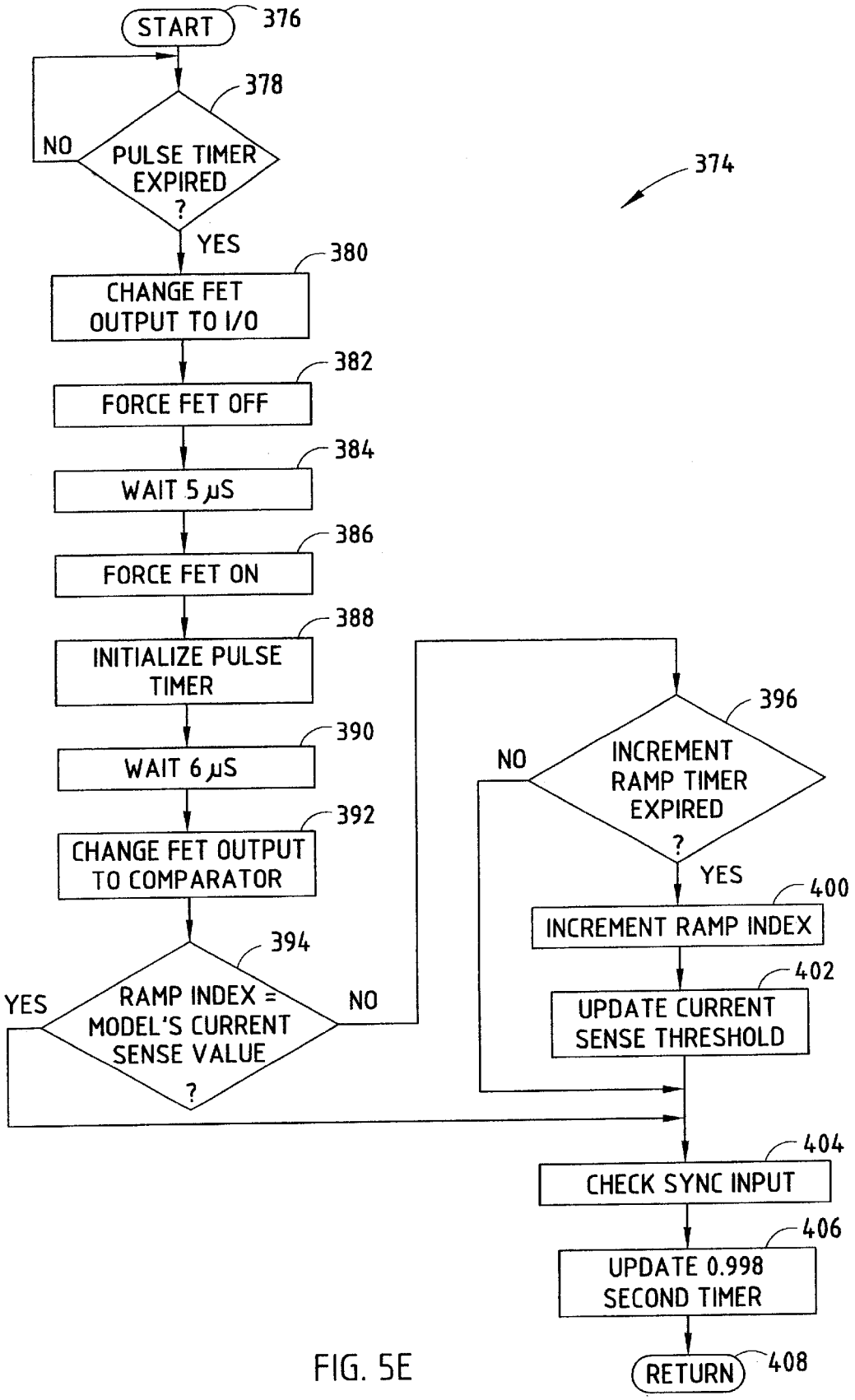

As is shown in FIG. 4B, the microcontroller U2 is programmed to provide a flash pulse on an output RB1, after initially charging capacitor C14 through inductor L3 and charging capacitors C6 and C7 (FIG. 3C) (both, for example, having values of 68 $\mu$F) through inductor L2, when 0.998 seconds have expired or the SYNC line (i.e., the input RB4) is low for five milliseconds. In a preferred embodiment, the microcontroller U2 is a PIC16C62X microcontroller that includes an internal comparator and a voltage reference module. After the initial power-up, the microcontroller U2 controls the amount of charge that is provided to capacitors C6 and C7 by selectively turning a FET Q12 off and on.

A sense resistor R8 (e.g., 1.82 ohms) is coupled to a source of the FET Q12 and a drain of the FET Q12 is coupled to a second side of the inductor L2, whose first side is coupled to a first side of the capacitor C14 When the FET Q12 is conducting, current flows through the inductor L2, the FET Q12 and the resistor R8 The microcontroller U2 monitors the voltage drop across the resistor R8 at an input RA1, via a filter network that includes resistor R19 (e.g., 4.7k ohm) and capacitor C8 (e.g., 100 pF), to determine the current Isen flowing through the FET Q12 When the microcontroller U2 causes the FET Q12 to stop conducting, the energy stored in the field of the inductor L2 is provided through a diode D7 to the capacitors C6 and C7 (i.e., the storage circuit).

An output RA4 of the microcontroller U2 is coupled to a base of a PNP transistor Q6, through a resistor R21 (e.g., 10 ohm), and directly to a base of NPN transistor Q9. A collector of the transistor Q6 is coupled to the common ground and an emitter of the transistor Q6 is coupled to an emitter of the transistor Q9. The emitters of the transistors Q6 and Q9 are coupled to a gate of the FET Q12 A collector of the transistor Q9 is coupled to a second side of resistor R12 (e.g., 8.2k ohm), via a resistor R14 (e.g., 10 ohm). A resistor R20 (e.g., 10k ohm) couples the base of the transistor Q9 to the second side of the resistor R12. A zener diode D4 is coupled between the second side of the resistor R12 and the common ground. A capacitor C5 is coupled across the zener diode D4. A resistor R18 (e.g., 10k ohm) is coupled between the RA4 output and a base of a PNP transistor Q5. A resistor R30 (e.g., 47k ohm) is coupled between an emitter and the base of the transistor Q5. The emitter of transistor Q5 is. coupled to VDD and a collector of transistor Q5 is coupled to the RA1 input. In one embodiment an internal voltage reference Vref of the microcontroller U2 is initialized such that Vref is a certain percentage of VDD (e.g., 4.167 percent).

For illustrative purposes, assuming that VL is equal to eighteen volts and the zener diode D4 has a zener voltage of 8.2 volts, the cycle is initiated by turning the FET Q12 off. To turn the FET Q12 off, the RA4 output of the microcontroller U2 is configured as an I/O and driven low. After a set time period, e.g., five microseconds, the input RA4 is set to a high impedance and a breakover voltage timer is started. The value used by the breakover voltage monitor is determined by the breakover voltage Vbr as sensed by the microcontroller U2 on input RA0. The RA0 input of the microcontroller U2 is coupled to a first side of resistor R15 (e.g., 10k ohm). The first side of the resistor R15 is also coupled to a second side of resistor R7 (e.g., 909k ohm), whose first side is coupled to a cathode of diode D7, which is also coupled to the capacitors C6 and C7. A capacitor C1 (e.g., 0.01 $\mu$F) is coupled across the resistor R15 and filters the signal provided to the RA0 input of the microcontroller U2.

When the output RA4 of the microcontroller U2 is in a high impedance state, the transistors Q6 and Q9 cause the FET Q12 to turn on. The signal at the current sense input RA1 then settles to the voltage dropped across the resistor R8 The initial current through the resistor R8 creates a voltage less than Vref and an output of an internal comparator of the microcontroller U2 goes high, at which point the mode of output RA4 is changed from I/O to comparator output. As the current through resistor R8 continues to increase, the voltage on the input RA1 eventually exceeds Vref and causes the comparator output to change from a high to a low state. This causes the RA4 input to change from high impedance to a low state.

When RA4 is driven low, the transistor Q5 turns on and latches the internal comparator in the low state. When Q5 is on, the voltage on RA1 goes to approximately VDD. In this manner, when the current (Isen) through the resistor R8 causes the voltage across the resistor R8 to exceed the threshold, set by Vref, the FET Q12 is prematurely shut-off. The transistor Q12 remains off and when the charge cycle timer expires, the cycle is ready to begin again. RA4 is then changed from the comparator mode to the I/O mode and driven low to initiate a new cycle.

As previously discussed, upon initial power-up, the capacitors C6 and C7 are discharged so the reference Vref is set to the lowest possible setting to minimize the in-rush current. During each predetermined period, e.g., every ten cycles, Vref is increased to allow more current to charge the inductor L2. Vref is no longer incremented when a value appropriate for the desired candela rating of the strobe circuit 100 is reached. According to another embodiment of the present invention, resistors R6 and R32 provide a flash intensity selector signal to an input AN3 of the microcontroller U2. Periodically, the microcontroller U2 reads the voltage present at the input AN3 to determine a desired flash intensity. For example, the selectable flash intensity may correspond to 15, 30, 75, 95 or 115 candela. It should be appreciated that a, greater or lesser number of selectable flash intensities can be readily achieved, according to the present invention.

As shown in FIG. 3B, a first side of the resistor R6 is coupled to an output of the regulator U3 and a second side of the resistor R6 is coupled to a first side of the potentiometer R32. A second side of the potentiometer R32 is coupled to the common ground and a wiper of the potentiometer R32 is coupled to the input AN3. In this manner, a user can adjust the potentiometer R32 to achieve a desired candela as the microcontroller U2 reads the level signal at the input AN3 and sets an appropriate breakover voltage Vbr.

FIG. 4C shows a timing diagram that shows the relationship between the output RA4 and the input RA1 of the microcontroller U2. As previously discussed, the input RA1 is coupled to the resistor R8 through a filter network, which includes the resistor R19 and the capacitor C8. When the output RA4 is high, the FET Q12 is conducting and when RA4 is low, the FET Q12 is turned off. When the FET Q12 is not conducting, the energy stored in the field of the inductor L2 is provided to the capacitors C6 and C7 to charge the capacitors C6 and C7 to a desired voltage (e.g., between 200 and 250 volts). Typical charge cycle timings are shown in FIG. 4C. Charging begins at point A. Point B depicts a point in time when the TCGX timer (i.e., the charge cycle timer) has expired and the current sense (Isen) is less then Vref. Point C depicts a point in time when the charging has begun again as RA4 transitions high. As shown at point D, the microcontroller U2 determines that the sensed current (Isen) has exceeded Vref and, as such, RA4 is prematurely driven low to reduce the amount of energy stored in the inductor L2. Point E is a point in time in which the TCGX timer once again expires. Point F depicts a point in time when RA4 transitions high and charging begins again. As previously discussed, the value of Vref is adjusted to achieve a desired flash intensity. That is, a larger Vref corresponds to a higher flash intensity (a higher breakover voltage Vbr) and a smaller Vref corresponds to a lower flash intensity.

FIG. 4B provides an exemplary timing diagram depicting the relationship between a number of signals of the strobe circuit 100. As previously mentioned, the circuit 100 is designed to respond to a synchronization pulse (SYNC) that is driven low for a time period TSYNC of, for example, five milliseconds. When the microcontroller U2 detects the SYNC pulse has been low for at least five milliseconds, on the input RB4, the microcontroller U2 initiates a routine, which causes a trigger signal (i.e., a FLASH signal) to be provided on an output RB1 of the microcontroller U2. The output RB1 is coupled to a gate of a silicon controlled rectifier SCRI, via a resistor R10 (e.g., 470 ohms). A diode D14 is coupled between the gate and ground to provide protection for the microcontroller U2. Upon detecting that the SYNC pulse is low for at least five milliseconds or 0.998 seconds has expired since the last flash, the microcontroller U2 provides a flash signal with an on-time of TFP, e.g., six microseconds, which initiates ionization of the gas within the flash tube F1, thus, allowing the tube F1 to emit light.

Subsequently, the microcontroller U2 decouples the power supply from the strobe circuit 100 by applying a low level signal on output RB2, which causes the FET Q10 to turn off. The low level signal is maintained on the RB2 output for a time period of TPFD, e.g., two milliseconds. Upon expiration of the period TPFD, a series of pulses is applied to the gate of the transistor Q1, via the output RB2, which are followed by the microcontroller U2 initiating a series of pulses on the output RA4, which provide a charging current to the storage circuit, including the capacitors C6 and C7. The series of pulses have a width TCG that preferably range between sixty microseconds and one-hundred forty microseconds and may be adjusted in, for example, two microsecond steps to achieve a desired breakover voltage. Preferably, the series of pulses are divided into cycles TCPX, which range from six hundred microseconds to 1.4 milliseconds. If the timing steps are inadequate to maintain a desired breakover voltage, Isen can be changed by one reference step (or more, if desired) and then followed again by an adjustment in the timing steps. Isen is also monitored and in the event that Vref is not exceeded, the timing steps are adjusted to a point where Vref is achieved and the maximum charge available from the power source is delivered to the storage circuit.

As previously discussed, the wider the pulse RA4, the more energy the inductor L2 provides, and upon turning off the FET Q12, the energy is provided to the capacitors C6 and C7. The microcontroller U2 evaluates the breakover voltage Vbr at the input RA0 to insure a consistent breakover voltage Vbr to produce a consistent flash brightness. If the flash voltage is too high, the pulse width TCG is decreased by two microseconds. However, if the flash voltage is determined to be to low, TCG is increased by two microseconds. Adjusting the signal provided on the output RA4 in this manner eliminates the need to classify power input types and the need to refer to a look-up table to compensate for a wide variety of power source conditions in real-time.

As previously discussed, the circuit 100 is designed such that the microcontroller U2 controls initial current draw (in-rush current), through the output RB2. As previously mentioned, in-rush current is preferably controlled in two phases. During a first one-half second of operation, phase one, a three microsecond pulse is applied on RB2 every ninety-eight microseconds. As RB2 drives the FET Q10, through the FET Q1, the pulse slowly precharges capacitors C14, C6 and C7. During the next one-half second of operation, phase two, the charge pulses are increased by 1.5 microseconds every 8.1 milliseconds until a one-hundred percent duty cycle is achieved. Pulsing the FET Q10 in this fashion eliminates the need for a fixed resistance across the drain and source of the FET Q10 to limit in-rush current. Additionally, the inductor L3 provides an additional filter for unfiltered power sources, which effectively reduces RMS current draw.

As previously mentioned, the potentiometer R32 allows the microcontroller U2 to determine which selectable flash intensity is desired by a user. The microcontroller U2 implements a routine which reads the voltage provided by the potentiometer R32, at the AN3 input, and then utilizes a look-up table to determine which of, for example, five unique breakover voltages should be used to evaluate.the signal at the input RA0. Preferably, the flash intensity selector input is evaluated after each flash to provide fault tolerance. Providing selectable flash intensities in this manner is generally preferable to providing a switch, which selects different components, depending upon the flash intensity desired.

FIGS. 5A–5E show an exemplary flow chart diagram of a routine 300 executed by the microcontroller U2 of the circuit 100. Upon power-up, the microcontroller U2 initiates the routine 300 at step 302. Next, in step 304, the microcontroller U2 initializes its input/output (I/O) before transitioning to decision step 306. In step 306, the microcontroller U2 determines whether the watchdog reset flag of the microcontroller U2 is set. When the watchdog reset flag is not set, control transitions from step 306 to step 308. It should be appreciated that the watchdog reset flag will not be set when the microcontroller U2 shuts down during normal operation (e.g., upon power-up from a sleep mode). In step 308, the microcontroller U2 calls a buck regulation subroutine.

In step 309 (see FIG. 5B), the microcontroller U2 initiates the buck regulation subroutine, at which point control transfers to decision step 310. In step 310, the microcontroller U2 determines whether 0.5 seconds have elapsed since initial power-up. If so, control transfers from step 310 to step 315. Otherwise, control transfers from step 310 to step 312. In step 312, the microcontroller U2 causes a three microsecond pulse to be provided on the RB2 output. Next, in step 314, the microcontroller U2 waits ninety-five microseconds before transitioning back to step 310. In this manner, the microcontroller U2 provides a series of pulses on the RB2 output with a width of three microseconds every ninety-eight microseconds until 0.5 seconds has elapsed since initial power-up.

As discussed above, the pulses on the RB2 output are applied to the gate of the FET Q1, which turns on responsive to a pulse on its gate. When the FET Q1 conducts a voltage is dropped across the resistor R29. The voltage across the resistor R29 is applied to the gate of the FET QIO causing the FET Q1 to turn on when the signal at the RB2 output is high. When the FET Q1 is not conducting, the resistor R34 pulls the gate of the FET Q1 to approximately the value of the voltage of the power supply.

In step 315, the microcontroller U2 initializes the on-time variable TON2 and the cycle time period TCYC2, which are preferably four microseconds and one-hundred microseconds, respectively. Next, in step 316, the microcontroller U2 causes an output pulse to be provided on the RB2 output that has a width of the on-time variable TON2. Then, in decision step 317, the microcontroller U2 determines whether the cycle time period TCYC2 has elapsed. If so, control transfers from step 317 to decision step 318. Otherwise, control loops on step 317 until the cycle time period TCYC2 elapses. In step 318, the microcontroller U2 determines whether 8.1 milliseconds has elapsed. If not, control transfers from step 318 to step 316. Otherwise, control transfers from step 318 to step 320, where the microcontroller U2 increments the on-time variable TON2.

Next, in decision step 322, the microcontroller U2 determines whether the on-time ariable TON2 is greater than or equal to the cycle time period TCYC2. If so, a one-hundred percent duty cycle is indicated and control transfers to step 324, where the subroutine returns to the calling routine at step 326. Otherwise, control transfers from step 322 to step 316. Thus, the microcontroller U2 provides a plurality of fixed duration pulses during a first predetermined time period and a plurality of variable duration pulses whose width increases during a second predetermined time period. As discussed above initially applying power to the circuit 100 in this manner limits the in-rush current to the circuit 100.

In step 326, the microcontroller U2 initializes the temperature check parameters (i.e., a temperature counter that tracks how long it takes for the watchdog timer to time-out) before transferring control to step 328. In step 328, the microcontroller U2 clears a cold indicator if a temperature count is equal to a warm value count. This is performed because when the capacitors C6 and C7 and the flash tube F1 of the circuit 100 are at temperature it is not necessary to increase the flash intensity to the next flash intensity level, as a correct flash intensity will be provided. Next, control transfers to step 330 where the temperature counter is incremented. In step 330, control returns to step 328 and the routine 300 continues to loop from step 328 to step 330 until the watchdog timer times-out. After the watchdog timer times-out, the routine 300 is initiated again at step 302, at which point control transfers to step 304 and then to step 306. Because the watchdog timer timed-out, as it was looping from step 328 to step 330, the watchdog reset flag is now set. As such, control transfers from step 306 to step 332, where the microcontroller U2 initializes its random access memory (RAM), at which point control transfers to step 333. In step 333, the microcontroller U2 initializes a two millisecond power-off timer.

Then, in step 334, the microcontroller U2 reads the signal at the input AN3 to determine the model specific parameters (i.e., which of a plurality of selectable flash intensities have been selected by a user through the setting of the potentiometer R32). Next, in step 336, the microcontroller U2 determines if the cold indicator is set. If the cold indicator is set, the microcontroller U2 utilizes a next brighter model parameter for a predetermined period. For example, if the signal provided by the potentiometer R32 indicates that fifteen candela has been selected by a user, the system would implement thirty candela to achieve a desired brightness, during a preselected.number of flashes (e.g., sixty flashes), before transitioning to the lower value. Then, in step 338, the routine 300 calls a do adjustment (DO ADJ) subroutine.

The do adjustment subroutine (see FIG. 5C) determines whether the breakover voltage Vbr, as seen by the microcontroller U2 at the input RA0 has exceeded a desired set value. In step 339, the subroutine is initiated, at which point control transfers to decision step 340. In step 340, the microcontroller U2 determines whether the breakover voltage Vbr was above a threshold. If so, control transfers from step 340 to decision step 342. Otherwise, control transfers from step 340 to decision step 352. If the breakover voltage Vbr is above the threshold, then the capacitors C6 and C7 have stored too much energy. If the breakover voltage Vbr did not exceed the threshold, then the capacitors C6 and C7 stored insufficient energy.

In step 342, the microcontroller U2 determines whether the pulse index is at its maximum (i.e., the RA4 pulse is at its minimum). If not, control transfers to step 350 where the pulse index is incremented in order to decrease the amount of energy stored by the capacitors C6 and C7. If the pulse index is at its maximum, then no further adjustment can be achieved with the pulse width (i.e., a fine adjustment) and control transfers from step 342 to decision step 344 to determine if an adjustment to the charge current threshold Vref (i.e., a coarse adjustment) can be made. In step 344, the microcontroller U2 checks the threshold Vref to determine whether the threshold Vref is at its minimum. If the threshold Vref is at its minimum, no further coarse adjustment can be achieved and control transfers to step 363, where the subroutine returns to the calling routine.

If the threshold Vref is not at it minimum in step 344, control transfers to step 346 where the microcontroller U2 adjusts the threshold Vref by decrementing it to a next lower value. Next, in step 348, the microcontroller U2 sets the pulse index (i.e., the fine adjustment) at its middle range value, at which point control transfers to step 363 where control returns to the calling routine. Table 1, set forth below, provides exemplary values (as a percentage of VDD) for Isen and Vbr for 15, 30, 75, 95 and 115 candelas, respectively.

TABLE 1

| | 15 cd | 30 cd | 75 cd | 95 cd | 115 cd |
|---|---|---|---|---|---|
| Isen | 20.833 | 25.000 | 28.125 | 29.167 | 33.333 |
| Vbr | 37.5 | 40.625 | 43.750 | 46.875 | 53.125 |

When the breakover voltage Vbr is not above a set threshold in step 340, control transfers to step 352. In step 352, the microcontroller U2 determines whether the charge a current Isen, i.e., the current through resistor R8, is tripping the internal comparator of the microcontroller U2. If so, control transfers to decision step 354 where the microcontroller U2 determines whether the index is equal to zero (i.e., whether the pulse at the output RA4 is at its maximum). If the index is not equal to zero in step 354, control transfers to step 362 where the microcontroller U2 decrements the pulse index (which increases the width of the pulse on the RA4 output) to increase the energy provided to the capacitors C6 and C7.

If the index is not equal to zero in step 354, control transfers to decision step 356 where the microcontroller U2 determines whether the threshold Vref is at its maximum. If the threshold Vref is at its maximum, control transfers from step 356 to step 342. This indicates that the circuit 100 is incapable of providing an adequate amount of energy to the capacitor C6 and C7 to achieve a desired flash intensity. Otherwise, control transfers from step 356 to step 358, where the microcontroller U2 increments the charge threshold Vref. Next, in step 360 the pulse index is set to a middle value. From step 360, control transfers to step 363.

Exemrlary values for Vref, as a percentage of VDD, are set forth below in Tables 2A and 2B.

TABLE 2A

| | |
|---|---|
| Level_0 | 0.000 |
| Level_1 | 4.167 |
| Level_2 | 8.333 |
| Level_3 | 12.500 |
| Level_4 | 16.667 |
| Level_5 | 20.833 |
| Level_6 | 25.000 |
| Level_7 | 28.125 |
| Level_8 | 29.167 |
| Level_9 | 31.250 |
| Level_10 | 33.333 |
| Level_11 | 34.375 |
| Level_12 | 37.500 |
| Level_13 | 40.625 |

TABLE 2B

| | |
|---|---|
| Level_14 | 41.667 |
| Level_15 | 43.750 |

TABLE 2B-continued

| | |
|---|---|
| Level_16 | 45.833 |
| Level_17 | 46.875 |
| Level_18 | 50.000 |
| Level_19 | 53.125 |
| Level_20 | 54.167 |
| Level_21 | 56.250 |
| Level_22 | 58.333 |
| Level_23 | 59.375 |
| Level_24 | 62.500 |
| Level_25 | 65.625 |
| Level_26 | 68.750 |
| Level_27 | 71.875 |

Upon returning from the do adjustment subroutine, control transfers to step 364 where the microcontroller U2 fetches an appropriate pulse time from a table in memory, using the pulse index. Next, in step 366, the microcontroller U2 resets the 0.998 second timer using the pulse index. Then, in step 368, the microcontroller U2 resets the ramp index and in step 369 the microcontroller U2 updates the threshold Vref. Next, in decision step 370 the microcontroller U2 determines whether the two millisecond power-off timer has expired. In not, control loops on step 370. When the two millisecond timer expires, control transfers from step 370 to step 371 where a duty cycle power subroutine (see FIG. 5D) is called.

In step 420 the duty cycle subroutine is initiated and control transfers to step 422 where power is turned on when the microcontroller U2 causes the RB2 output to transition to a high level (see FIG. 4B). Next, in step 424 the microcontroller waits for a period TPH, e.g., sixty-six microseconds before transitioning to step 426 where the microcontroller U2 causes the RB2 output to transition to a low level. In step 428, after waiting for a period TPL, e.g., fifty-five microseconds, control transfers to decision step 430. When four milliseconds has elapsed since initialization of the duty cycle subroutine, control transfers to step 432 where the subroutine returns to the calling routine at decision step 372.

In decision step 372, the microcontroller U2 determines whether 0.998 seconds have elapsed or the SYNC line has been low for at least five milliseconds. If so, control transfers from step 372 to step 409, where the microcontroller U2 records the breakover voltage Vbr, before initiating a flash, by providing a control signal (i.e., a FLASH signal) at the output RB1, in step 410. As previously discussed the output RB1 is coupled to the gate of the silicon controlled rectifier SCR1, via the resistor R10.

Next, in decision step 412, the microcontroller U2 determines whether the SYNC line is low. If the SYNC line is not low in step 412, control transfers to step 333 where the microcontroller U2 initializes the two millisecond power-off timer. If the SYNC line is low in step 412, control transfers to decision step 414 where the microcontroller U2 determines if the SYNC line has transitioned high for two milliseconds. The microcontroller U2 loops on step 414 until the SYNC line is high for two milliseconds at which point control transfers to step 334. In step 372, when the SYNC line has not been low for five milliseconds or 0.998 seconds has not elapsed since the last time the 0.998 second timer was reset, control transfers to step 374 where a charge storage circuit subroutine is implemented.

In step 376 (see FIG. 5E), the charge storage circuit subroutine is initiated, at which point control transfers to decision step 378. In step 378, the microcontroller U2 determines whether the pulse timer (i.e., the timer that determines the pulse width of a pulse provided on the RA4 output of the microcontroller U2) has expired. If not, control loops on step 378.

When the pulse timer expires in step 378, control transfers to step 380. In step 380, the microcontroller U2 changes the RA4 pin to an I/O. Then, in step 382, the microcontroller U2 forces the FET Q12 off. Next, in step 384, the microcontroller U2 waits five microseconds before transitioning to step 386 where the microcontroller forces the FET Q12 on, by applying a high impedance level on the RA4 output. Then, in step 388, the microcontroller U2 initializes the pulse timer.

Next, in step 390, the microcontroller waits six microseconds, to allow a settling time, for the voltage across resistor R8, before switching the mode of the RA4 pin from I/O to comparator. Then, the microcontroller U2 changes the mode of the RA4 pin from an I/O to a comparator input. Next, in decision step 394, the microcontroller U2 determines whether the ramp index is equal to the model's current sense value. If the ramp index is equal to the model's current sense value, control transfers from step 394 to step 404. Otherwise, control transfers from step 394 to decision step 396. In decision step 396, the microcontroller U2 determines whether the increment ramp timer has expired (e.g., whether ten cycles has passed since the threshold Vref was last incremented). If not, control transfers from step 396 to step 404. Otherwise, control transfers from step 396 to step 400 where the microcontroller U2 increments the ramp index. Next, in step 402, the microcontroller updates the current sense threshold Vref. Then, in step 406, the microcontroller U2 updates the 0.998 second timer before returning to the calling routine in step 408.

Accordingly, a strobe circuit and routine have been described herein that efficiently charge an associated storage circuit, maintain a controlled breakover voltage for a flash tube, reduce in-rush current to the circuit and provide selectable flash intensities.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A visual alarm device, comprising:

a flash tube for providing a visual indication responsive to a trigger signal; and a strobe circuit coupled between the flash tube and a power source, the strobe circuit causing the flash tube to emit light at a desired flash rate, the strobe circuit including:

a storage circuit coupled to the flash tube;

an in-rush current limiting circuit coupled between the storage circuit and the power source, the in-rush current limiting circuit including a first switching device with a control input; and a control unit coupled to the control input, the control unit periodically asserting a control signal on the control input, the first switching device providing energy to the storage circuit responsive to the control signal, wherein the control signal includes a plurality of fixed duration pulses during a first predetermined time period.

2. The visual alarm device of claim 1, wherein the control signal includes a plurality of variable duration pulses whose width increases during a second predetermined time period.

3. The visual alarm device of claim 1, wherein the control unit is a microcontroller.

4. A visual alarm device, comprising:

a flash tube for providing a visual indication responsive to a trigger signal; and a strobe circuit coupled between the flash tube and a power source, the strobe circuit causing the flash tube to emit light at a desired flash rate, the strobe circuit including:

a storage circuit coupled to the flash tube;

a monitoring circuit coupled to the storage circuit, the monitoring circuit providing a breakover signal that provides an indication of a breakover voltage on the storage circuit;

a breakover voltage limiting circuit coupled to the storage circuit and the power source, the breakover voltage limiting circuit including a first switching device with a control input; and a control unit coupled to the monitoring circuit, the control unit periodically asserting a control signal on the control input, wherein a pulse width of the control signal is varied responsive to the breakover signal and the first switching device provides energy to the storage circuit responsive to the control signal.

5. The visual alarm device of claim 4, wherein the trigger signal is produced by the control unit.

6. The visual alarm device of claim 4, further including:

a flash intensity selector for providing a plurality of selectable flash intensities, wherein the flash intensity selector is coupled to the control unit, and wherein the magnitude of the breakover voltage is varied responsive to the flash intensity selector.

7. The visual alarm device of claim 6, wherein the flash intensity selector is a potentiometer and the plurality of selectable flash intensities correspond to 15, 30, 75, 95 and 115 candela.

8. The visual alarm device of claim 6, wherein the control unit evaluates an output provided by the flash intensity selector after each flash to determine which of the selectable flash intensities is selected.

9. The visual alarm device of claim 4, wherein the control unit is a microcontroller.

10. The visual alarm device of claim 4, wherein the control unit maintains the breakover voltage at a substantially consistent level such that an intensity of the light emitted by the flash tube is substantially repeated from one flash to a next flash.

11. An alarm system, comprising:

a control panel including a controller coupled to a sensor; and a visual alarm device including:

a flash tube for providing a visual indication responsive to a trigger signal; and a strobe circuit coupled between the flash tube and a power source, the strobe circuit causing the flash tube to emit light at a desired flash rate, the controller causing the power source to provide power to the strobe circuit responsive to the sensor, the strobe circuit including:

a storage circuit coupled to the flash tube;

an in-rush current limiting circuit coupled between the storage circuit and the power source, the in-rush current limiting circuit including a first switching device with a control input; and a control unit coupled to the control input, the control unit periodically asserting a control signal on the control input, the first switching device providing energy to the storage circuit responsive to the control signal, wherein the control signal includes a plurality of fixed duration pulses during a first predetermined time period.

12. The alarm system of claim 11, wherein the control signal includes a plurality of variable duration pulses whose width increases during a second predetermined time period.

13. The alarm system of claim 11, wherein the control unit is a microcontroller.

14. An alarm system, comprising:

a control panel including a controller coupled to a sensor; and a visual alarm device, including:

a flash tube for providing a visual indication responsive to a trigger signal; and a strobe circuit coupled between the flash tube and a power source, the strobe circuit causing the flash tube to emit light at a desired flash rate, the controller causing the power source to provide power to the strobe circuit responsive to the sensor, the strobe circuit including:

a storage circuit coupled to the flash tube;

a monitoring circuit coupled to the storage circuit, the monitoring circuit providing a breakover signal that provides an indication of a breakover voltage on the storage circuit;

a breakover voltage limiting circuit coupled to the storage circuit and the power source, the breakover voltage limiting circuit including a first switching device with a control input; and a control unit coupled to the monitoring circuit, the control unit periodically asserting a control signal on the control input, wherein a pulse width of the control signal is varied responsive to the breakover signal and the first switching device provides energy to the storage circuit responsive to the control signal.

15. The alarm system of claim 14, further including:

a flash intensity selector for providing a plurality of selectable flash intensities, wherein the flash intensity selector is coupled to the control unit, and wherein the magnitude of the breakover voltage is varied responsive to the flash intensity selector.

16. The alarm system of claim 15, wherein the flash intensity selector is a potentiometer and the plurality of selectable flash intensities correspond to 15, 30, 75, 95 and 115 candela.

17. The alarm system of claim 15, wherein the control unit evaluates an output provided by the flash intensity selector after each flash to determine which of the selectable flash intensities have been selected.

18. The alarm system of claim 14, wherein the control unit is a microcontroller.

19. The alarm system of claim 14, wherein an intensity of the light emitted by the flash tube is substantially repeated from one flash to a next flash.

20. The alarm system of claim 14, wherein the control unit maximizes the amount of energy delivered to the storage circuit while continuing to cause the flash tube to emit light at the desired flash rate when the control unit senses that the power source is incapable of providing an adequate amount of energy to achieve a desired intensity from the flash tube.

21. A visual alarm device, comprising:

a flash tube for providing a visual indication responsive to a trigger signal; and a strobe circuit coupled between the flash tube and a power source, the strobe circuit causing the flash tube to emit light at a desired flash rate, the strobe circuit including:

a storage circuit coupled to the flash tube;

a monitoring circuit coupled to the storage circuit, the monitoring circuit providing a breakover signal that provides an indication of a breakover voltage on the storage circuit;

breakover voltage limiting circuit coupled to the storage circuit and the power source, the breakover voltage limiting circuit including a first switching device with a control input; and a control unit coupled to the monitoring circuit, the control unit periodically asserting a control signal on the control input to provide energy to the storage circuit, wherein a pulse width of the control signal is varied responsive to the breakover signal, and wherein the control unit increases the energy provided to the storage circuit when the control unit determines that the strobe circuit is below a predetermined temperature.

22. A visual alarm device, comprising:

a flash tube for providing a visual indication responsive to a trigger signal; and a strobe circuit coupled between the flash tube and a power source, the strobe circuit causing the flash tube to emit light at a desired flash rate, the strobe circuit including:

a storage circuit coupled to the flash tube;

a monitoring circuit coupled to the storage circuit, the monitoring circuit providing a breakover signal that provides an indication of a breakover voltage on the storage circuit;

a breakover voltage limiting circuit coupled to the storage circuit and the power source, the breakover voltage limiting circuit including a first switching device with a control input; and a control unit coupled to the monitoring circuit, the control unit periodically asserting a control signal on the control input to provide energy to the storage circuit, wherein a pulse width of the control signal is varied responsive to the breakover signal and wherein the breakover voltage limiting circuit limits the energy provided to the storage circuit when a reference threshold is crossed.

* * * * *

UNITED STATES PATENT AND TRADEMARK OFFICE

CERTIFICATE OF CORRECTION

PATENT NO. : 6,556,132 B1
DATED : April 29, 2003
INVENTOR(S) : Greg R. Pattok and John R. Pacelli It is certified that error appears in the above-identified patent and that said Letters Patent is hereby corrected as shown below:

Column 1,
Line 12, “damong” should be -- among --;

Column 2,
Line 61, “10A” should be -- 100A --;

Column 4,
Line 7, “(e:g., 1 mH)” should be -- (e.g., 1 mH) --;
Lines 22 and 24, “gate of the FET Q1” should be -- gate of the FET Q10 --;
Line 62, after “C14” insert -- . --;
Line 64, after “R8” insert -- . --;

Column 5,
Line 12, after “Q12” insert -- . --;

Column 7,
Line 66, after “evaluate” delete “.”;

Column 8,
Line 40, “the FET Q1” should be -- the FET Q10 --;
Line 42, “gate of the FET Q1” should be -- gate of the FET Q10 --;
Line 60, “ariable” should be -- variable --;

Column 9,
Line 39, after “preselected” delete “.”;

Column 10,
Line 45, “Exemrlary” should be -- Exemplary --; and

UNITED STATES PATENT AND TRADEMARK OFFICE

CERTIFICATE OF CORRECTION

PATENT NO. : 6,556,132 B1
DATED : April 29, 2003
INVENTOR(S) : Greg R. Pattok and John R. Pacelli It is certified that error appears in the above-identified patent and that said Letters Patent is hereby corrected as shown below:

Column 15,
Line 10, before "breakover" insert -- a --.

Signed and Sealed this

Sixth Day of April, 2004

JON W. DUDAS
*Acting Director of the United States Patent and Trademark Office*